US005989062A

United States Patent [19]

Daoud

[11] Patent Number: 5,989,062

[45] Date of Patent: Nov. 23, 1999

[54] REVERSIBLE RECEPTACLE FOR MOUNTING CONNECTORS

[75] Inventor: Bassel Hage Daoud, Parsippany, N.J.

[73] Assignee: Lucent Technologies Inc., Murray Hill, N.J.

[21] Appl. No.: 08/903,868

[22] Filed: Jul. 31, 1997

[51] Int. Cl.[6] ..... H01R 13/60

[52] U.S. Cl. ..... 439/532; 439/716

[58] Field of Search ..... 439/532, 715, 439/716, 719

[56] References Cited

U.S. PATENT DOCUMENTS

| | | | |
|---|---|---|---|
| 4,729,064 | 3/1988 | Singer, Jr. | 439/716 |
| 5,595,507 | 1/1997 | Braun et al. | 439/716 |

*Primary Examiner*—Gary F. Paumen
*Assistant Examiner*—Antoine Nganajui
*Attorney, Agent, or Firm*—Claude R. Narcisse

[57] ABSTRACT

A reversible receptacle for housing single ended or double ended connectors where said receptacle can be attached to a structure frontwards or backwards and can be manipulated without any interference from heavy gauge ground cables. The receptacle includes a reversible frame that has both a front and back opening. The openings permit selective access to the mounted connectors.

12 Claims, 4 Drawing Sheets

REVERSIBLE RECEPTACLE FOR MOUNTING CONNECTORS

BACKGROUND OF THE INVENTION

1. Field of the Invention

This invention relates to a receptacle for mounting connectors and in particular to a reversible receptacle for mounting connectors used in telecommunications.

2. Description of the Related Art

Telecommunication systems often use metallic wires to carry electrical signals to and from a subscriber's site. Typically the wires (e.g., tip and ring in a telephone system) terminate at the subscriber's site at a terminal block to which the subscriber's telecommunications equipment (e.g., telephone, facsimile machine, modem) are connected. In many instances, the wires are inserted into multiple contact connectors where each contact corresponds to an individual wire. One example of a multiple contact connector is the well known ZIDC (Z-shaped Insulation Displacement Connector) manufactured by Lucent Technologies Inc. of Murray Hill, N.J. Another multiple contact connector manufactured by Krone, Inc. of Germany.

The connectors are typically disposed in a housing which serves to store the connectors and localize them to one specific location to facilitate any future maintenance, additional wiring or rewiring that may be needed. The housing of the connectors also allows electrical access to each of the terminated wires so that they can be monitored electrically and/or visually. Many times, the connectors such as the ones discussed above are configured to allow protection circuitry to be connected thereto. The protection circuitry are used to divert occasional large current surges to electrical ground and thereby prevent the subscriber's equipment and the metallic wires from being damaged. The large current surges are often from lightning, voltage spikes and other energy surges that cause large amounts of current to flow through the metallic wires. The protection circuitry serves to create an electrical path to a robust electrical ground allowing the large currents to be routed safely to ground. Typically, the robust electrical ground comprises the housing electrically connected to a heavy gauge wire (e.g., thick metallic stranded cables) connected to earth ground. The housing and the heavy gauge wire must be able to withstand (i.e., provide a path to earth ground for the surge current without melting) the electrical energy carried by the surge currents.

FIG. 1 depicts a typical connector housing configuration. For clarity, only a portion of the housing is shown with only one connector (118) disposed therein. Connector 118, which is manufactured by Krone Inc., has contacts 119 is mounted onto two oppositely positioned housing extensions 102 each having an extension opening 116. Housing 100 comprises top surface 122, side surfaces 114, back surface 120 and bottom surface 124. Grounding connector 108 having cable openings 112 and secure openings 110 is attached to one of the side surfaces 114 of housing 100. Heavy gauge ground cables (not shown), typically connected to earth ground, are inserted in openings 114 and 116 and are secured to grounding connector 108 by inserting screws (not shown) into secure openings 110. Secure openings 110 are sometimes threaded to facilitate the insertion of screws therein. Housing 100 is attached to a structure (not shown) with the use of mounting brackets 104. Typically a screw, nail or other fastening device (not shown) is inserted into bracket openings 106 for mounting housing 100 to the structure.

Bundles of wires (not shown) terminate at the connector contacts. These bundles of wires enter and exit housing 100 though openings (not shown) in back surface 120 or through openings in side surface 114 between extensions 102. There is often a need to troubleshoot particular wires or wire pairs and thus access to the back of the connectors is often required. Also, surge protection circuitry is often attached to the connectors to prevent subscriber equipment connected thereto from being damaged. The installation of such circuitry to one or more connectors often requires the temporary removal of such connectors or access to the rear of such connectors. Further, double ended connectors, such as the double ended ZIDC connectors manufactured by Lucent Technologies, Inc., are now frequently used instead of the single ended connectors such as the Krone connector 118 depicted in FIG. 1. The use of double ended connectors often necessitates access to the rear of the housing during installation for wiring, visual inspection and electrical monitoring of such connectors.

The housing depicted in FIG. 1 cannot efficiently use double ended connectors as there would be little or no access to one end of these connectors when disposed in housing 100. Troubleshooting wires or connector contacts for the housing connector combination of FIG. 1 is labor intensive as access to the rear of the connectors often requires that the housing be dismounted from the structure to which it is mounted and the connectors removed from the housing (100) in order to gain access to the rear of such connectors. This is often a very awkward, tedious and slow process complicated by many bundles of wires that typically enter and exit the housing. Further, the ground cables (not shown) attached to the housing 100 are typically heavy gauge or thick metallic cables making manipulation of the housing difficult. Consequently, in many cases the ground cables have to be disconnected from the housing when making a wiring change or troubleshooting the wiring.

Another connector housing design has a receptacle portion and a base portion. The base is attached to a structure while the receptacle portion is hingedly attached to the base. The receptacle portion, which is used to house connectors, has a rear opening that provides access to the rear of any mounted connector. Double ended connectors can be mounted within the receptacle portion such that when it is swung about the hinged attachment, access to both ends of the mounted connectors is possible. Typically, both the base and the receptacle are made of a metallic material and a ground cable is attached to the base to provide the proper ground. The hinge connection that connects the base to the receptacle is also typically metallic thereby providing electrical ground to the receptacle portion. Although this design solves the problem of obtaining access to both ends of a mounted double ended connector, it has several disadvantages. First, the receptacle portion when swung around to expose the rear ends of the mounted connectors does not provide a conformable orientation in order to comfortably perform rear wiring. This is because the back of the receptacle portion is often angled with respect to the base. Therefore, the connectors are often times wired individually outside of the housing and then are mounted onto the housing when all wiring is completed. This is often a labor intensive and thus costly operation. Also, the hinge connection included in this design makes the design and manufacture of such a device costly. Further, this design requires an additional flexible ground cable that is connected to the swingable receptacle portion as that portion may not have the proper ground because the hinge mechanism which connects the base to the swingable receptacle often does not provide a reliable ground connection. The additional ground cable connected to the receptacle makes manipulation of the receptacle even more difficult and thus complicates troubleshooting and/or wiring of the mounted connectors.

Therefore, there exists the need to have a connector receptacle which can be easily oriented to allow access to both ends of mounted connectors therein thereby facilitating wiring of mounted connectors. There exists an additional need to have a connector receptacle that has a robust grounding mechanism that does not interfere with the wiring of the connectors and the manipulation of the housing.

SUMMARY OF THE INVENTION

The present invention provides for a reversible connector receptacle having front and back openings where said reversible connector receptacle is releasably and reversibly attachable to a structure and an electrical ground connection. At least one connector, having a first end and a second end, can be mounted within the receptacle whereby this connector can be removed, selectively wired, or visually and/or electrically monitored through one of the openings while the receptacle is mounted to the structure without any interference from any electrical ground cables attached to the electrical ground connection. The reversible connector receptacle can be releasably and reversibly attached to the structure and the electrical ground connection with either the back opening or the front opening facing the structure.

The reversible connector receptacle comprises a frame having a front opening and a back opening. The reversible connector receptacle further comprises a plurality of arms extending frontward and perpendicularly from the frame for mounting connectors to the frame such that the first end of each of the mounted connectors faces the front opening and the second end faces the back opening. The frame is releasably and reversibly attached to a structure.

DETAILED DESCRIPTION

Figure 1:
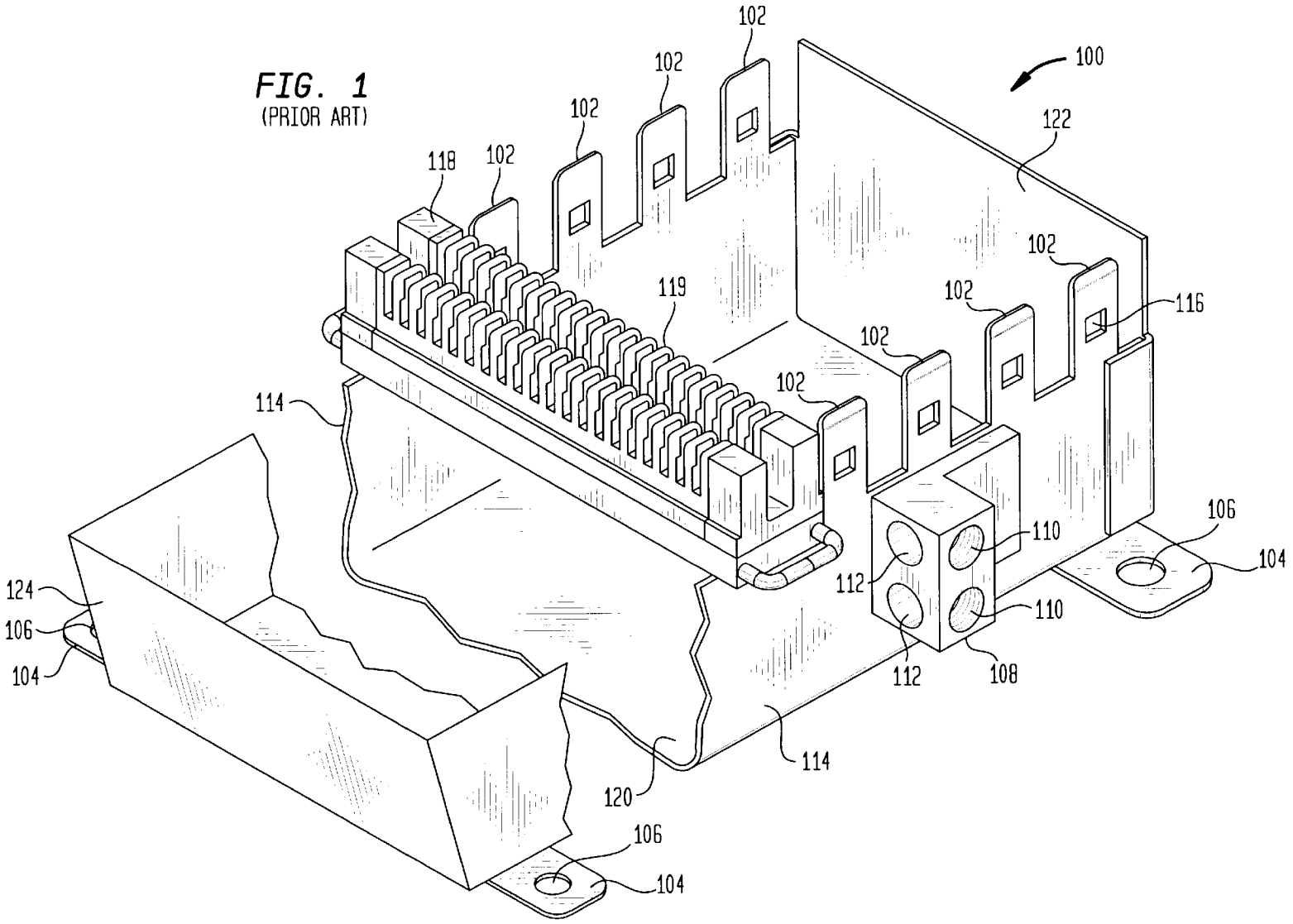
FIG. 1 (PRIOR ART)
FIG. 1 shows a prior connector housing.
Figure 2:
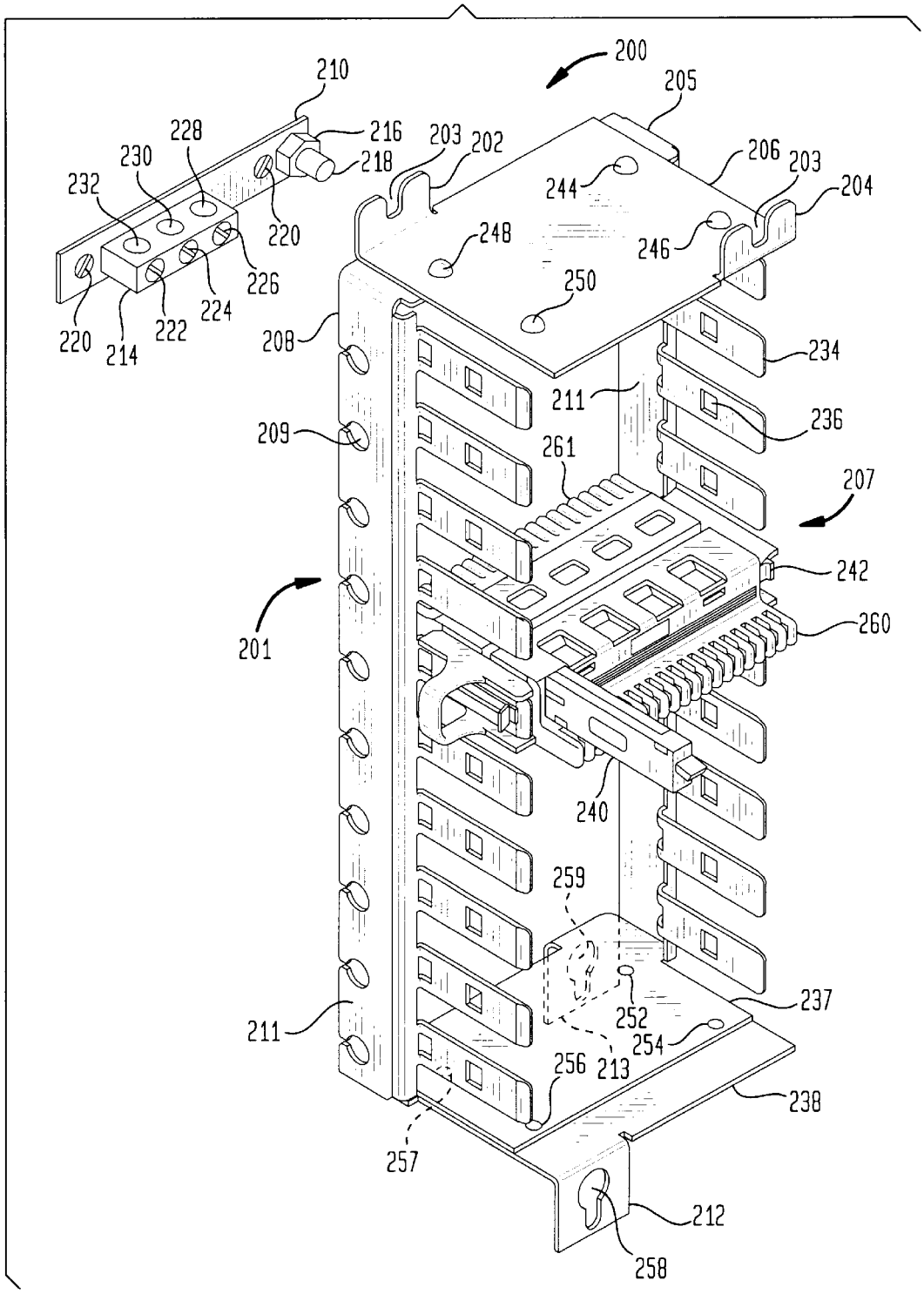
FIG. 2 shows a perspective view of the present invention.

FIG. 2 depicts the present invention having mounted therein double ended ZIDC connector 242 to which surge protector module 240 is connected. Reversible connector receptacle 200 comprises frame 208 for housing at least one connector. Frame 208 has front opening 207 and back opening 201. Back opening 201 provides rear access to frame 208 and to any connector housed therein. Frame 208 also has top portion 205, bottom portion 237 and side panels 211, and whose top rear bracket 202 is positioned so that it can be releasably attached to bolt 218 with nut 216. Top rear bracket 202 has notch 203 sized to properly engage bolt 218. Side panels 211 have side openings 209 though which electrical wires can enter and/or exit frame 208. Arms 234, each having an opening 236, extend frontward and substantially perpendicularly from side panels 211 for slidably mounting connectors 242 within frame 208. Connector 242 when housed within frame 208 has a first end 260 facing front opening 207 and a second end 261 opposite the first side facing back opening 201. Front opening 207 exposes fully the first end of connector 242 and back opening 201 exposes fully the second end of connector 242. It should be understood that the openings can be sized to expose fully both sides of any number of connectors mounted within frame 208.

Reversible connector receptacle 200 further comprises electrical ground connection 210 from which bolt 218 extends and which is fixedly attached to a structure (not shown) with screws or fasteners 220. The structure, although not shown, can be a surface of a wall, a post, a beam, or any other structure to which electrical ground connection 210 can be fixedly attached. Electrical ground contact 214 is fixedly attached to electrical ground connection 210. Electrical ground connection 210 is preferably a metallic bus bar. Frame 208 is preferably metallic. Electrical ground connection 210 provides electrical ground to frame 208. Electrical ground contact 214 is preferably a metallic ground cable receptacle into which ground cables (not shown) can be inserted in openings 228, 230 and 232 and fixedly secured with screws 226, 224 and 222 respectively.

After the ground cables (not shown) are secured to electrical ground contact 214, frame 208 is releasably and reversibly attached to the structure with back opening 201 facing the structure. A threaded bolt (not shown but similar to bolt 218) can be extended from the structure to allow frame 208 to be releasably and reversibly attached to the structure via brackets 202 and 213 (or brackets 204 and 212) and a nut (similar to nut 216). Frame 208 can also be reversibly and releasably attached to electrical ground connection 210 via bracket 202 or 204. Electrical ground connection 210 would thus provide electrical ground to frame 208 via the ground cables. Bottom rear bracket 213 has keyhole 259 for engaging a lower bolt 219 with nut 217 (see FIG. 3) attached to the support structure (not shown). Thus, frame 208 can be releasably and reversibly attached to the structure or to electrical ground connection 210. Bottom front bracket 212 also has a keyhole opening (258). Keyhole openings 258 and 259 allow for ease of attachment and detachment of frame 208. Once Frame 208 is attached to the structure or to electrical ground connection 210 (via brackets 202 and 213), connectors 242 can be mounted within frame 208 through front opening 207. Further, the electrical contacts at the first ends of the mounted connectors (242) can be selectively wired, the connectors (242) can be visually or electrically monitored, mounted connectors can be removed from frame 208, additional connectors can be mounted or any other troubleshooting of the connectors and the wires connected thereto can be done.

Frame 208 can be detached from the structure ( or electrical ground connection 210) with a downward force, then re-oriented and attached to the structure (via brackets 204 and 212) or electrical ground connection 210 such that rear opening 201 faces frontward (back opening 207 facing the structure) allowing wiring, troubleshooting, installation and/or removal of connectors through the rear opening 201 without any interference from the ground cables and without having to disconnect the ground cables. When wiring, mounting of connectors or troubleshooting through back opening 201 is done, frame 208 can again be detached from the structure or electrical ground connection 210, oriented again and reattached to the structure (or electrical ground connection 210) with front opening 207 facing frontward. Thus, frame 208 is reversible in that it can be attached to a structure with either the front or the rear opening facing frontward. The wiring, mounting of connectors and/or troubleshooting can also be done while frame 208 is detached from the structure.

Still referring to FIG. 2, top panel 206 is attached to frame top portion 205 with the use of rivets 244, 246, 248 and 250. Top panel 206 can also be welded, soldered or otherwise fixedly attached to frame top portion 205 through the use of well known techniques. Bottom panel 238 is attached to frame bottom portion 237 with rivets 252, 254, 256 and 257. Bottom panel 238 can also be welded, soldered or otherwise fixedly attached to frame bottom portion 237 through the use of well known techniques. Brackets 202 and 204 integrally form part of top panel 206 and are bent at a substantially perpendicular angle with respect to top panel 206. Brackets 202 and 204 are diagonally positioned with respect to each other. Brackets 212 and 213 integrally form part of bottom panel 238 and are bent at a substantially perpendicular angle with respect to bottom panel 238. Brackets 212 and 213 are diagonally positioned with respect to each other.

Figure 3:
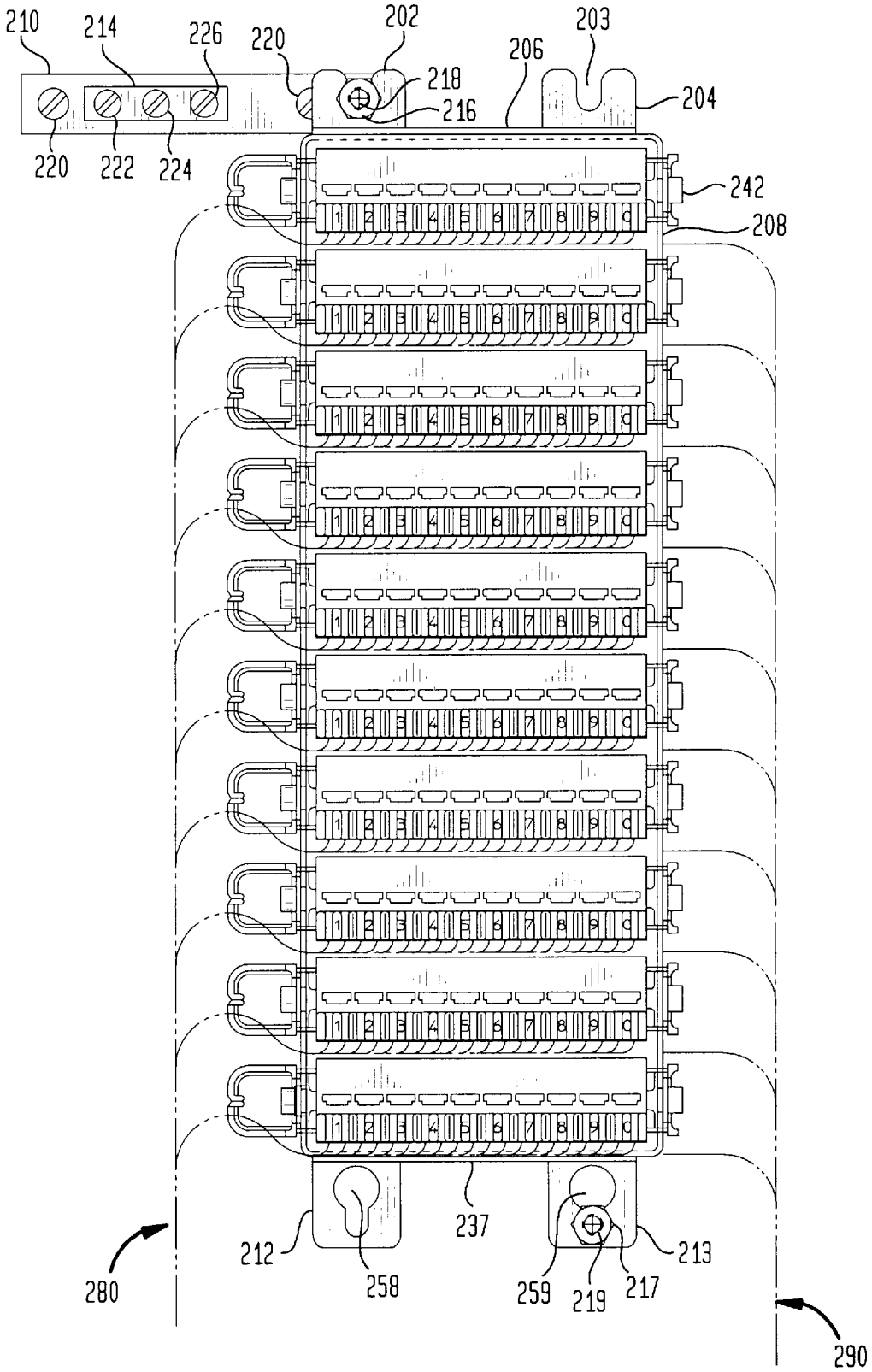
FIG. 3 shows a front view of the present invention fully populated with connectors.

Referring to FIG. 3, there is shown frame 208 attached to electrical ground connection 210 and lower bolt 219 which is attached to a structure (not shown). Thus, frame 208 can be simultaneously releasably and reversibly attached to the structure and electrical ground connection 210. Top rear bracket 202 engages bolt 218 which is preferably threaded so that nut 216 can properly secure bracket 202 to bolt 218 thus attaching frame 208 to electrical ground connection 210. Also, those of ordinary skill in the art to which this invention belongs can readily understand that another bolt 219 emanating from and attached to the structure can be advantageously positioned to engage with keyhole 259 of bottom rear bracket 213. Bolt 219 is preferably threaded such that nut 217 can properly secure bracket 213 to bolt 219. Bolt 219 can be attached to another bus bar (not shown) similar to ground bus bar 210. It should be understood that other attachment mechanisms well known to those skilled in the art to which this invention belongs can be used to releasably attach frame 208 to electrical ground connection 210.

Frame 208 can be populated with double ended connectors (e.g., ZIDC connectors) or various combinations of double ended and single ended connectors 242 which have wires (connected to subscriber equipment) attached to their contacts through side openings 209 and front opening 207. Frame 208 is not limited to accommodate a specific number of connectors. Wires (290) coming into the subscriber's site are routed through back opening 201 and connected to contacts of connectors 242. Wires (280) connected to subscriber equipment (not shown) and routed through front opening 207 are connected to contacts of connectors 242. It should be noted that top brackets 202 and 204 can also be constructed with keyhole openings similar to those of bottom brackets 212 and 213. The bottom brackets in turn can be constructed with notches. Thus, frame 208 can have top brackets having keyhole openings and bottom brackets having notches. The notches and the keyhole openings are sized to properly engage bolts 218 and 219 respectively.

Figure 4:
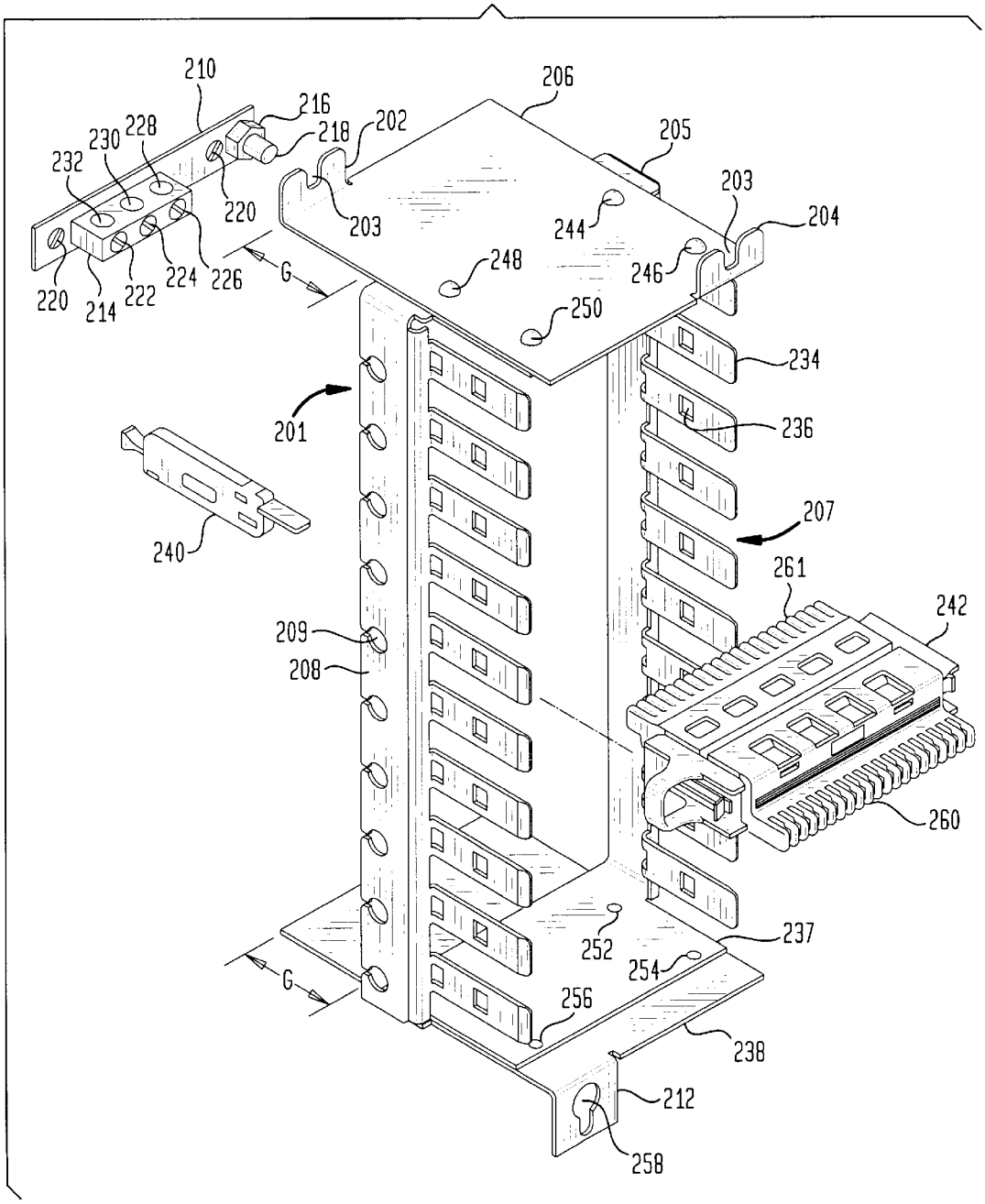
FIG. 4 shows the present invention with elongated top and bottom panels.

Referring to FIG. 4, there is shown the present invention with elongated top and bottom panels 206 and 238 allowing surge protector module 240 to be connected to double ended connector 242 through rear opening 201. When frame 208 is attached to a structure, there exists a gap of at least length G between the structure and the rear opening of frame 208. This gap allows the installation or removal of surge protector module 240 while the frame is attached to the structure and/or electrical ground connection 210. The gap, G, also allows troubleshooting of mounted connectors while frame 208 is attached to the structure.

I claim:

1. A reversible connector receptacle for housing at least one connector, each connector having a first end and a second end opposite the first end, the reversible connector receptacle comprising:

a frame having a front opening and a back opening;

a plurality of arms extending substantially perpendicularly and frontward from the frame for mounting the at least one connector such that the first end of the connector faces the front opening and the second end of the connector faces the back opening; and the frame is reversibly and releasably attached to a structure for selective access to the at least one connector from either of the front opening and the back opening.

2. The reversible connector of claim 1 where the frame is metallic.

3. The reversible connector of claim 1 where the front opening exposes fully the first end of all mounted connectors and the back opening exposes fully the second end of all mounted connectors.

4. A reversible connector receptacle for housing a plurality of connectors, each connector having a first end and a second end opposite the first end, the reversible connector receptacle comprising:

a frame having side panels, a front opening, a back opening, a top portion and a bottom portion where the top and bottom portions each has mounting brackets extending therefrom;

arms extending frontward and substantially perpendicularly from the side panels for mounting connectors to the frame such that the first end of each mounted connector faces the front opening and the second end of each connector faces the back opening;

an electrical ground connection to which the frame is releasably and reversibly attached, the electrical ground is configured to be fixedly attached to a structure.

5. The reversible connector of claim 4 where the electrical ground connection is a metallic bus bar having electrical contacts to which electrical ground conductors can be fixedly secured.

6. The reversible connector receptacle of claim 4 wherein electrical ground cables are attached to the electrical ground connection and the frame can be releasably and reversibly mounted to the electrical ground connection allowing wiring, troubleshooting, installation and removal of connectors without any interference from the attached ground cables.

7. The reversible connector receptacle of claim 4 wherein the mounting brackets have keyhole apertures allowing for ease of attachment and detachment of the frame.

8. The reversible connector receptacle of claim 4 where the front openings of the frame exposes fully the first side of all mounted connectors and the back opening of the frame exposes fully the second side of all mounted connectors.

9. The reversible connector receptacle of claim 4 where the frame is simultaneously releasably and reversibly attached to the electrical ground connection and the structure.

10. The reversible connector receptacle of claim 4 where the frame has an elongated top panel attached to the top portion and an elongated bottom panel attached to the bottom portion such that there is a gap between the back opening of the frame and the structure.

11. A method for wiring connectors installed in a reversible connector receptacle, the connectors having a first end and a second end opposite the first end where at least one of said first and second ends has a plurality of electrical contacts, the method for wiring connectors comprising the steps of:

attaching an electrical ground connection to a structure;

releasably attaching a frame to the structure and to the electrical ground connection where the frame has a front opening and a back opening such that the back opening faces the structure;

mounting the connectors within the frame such that the first side of each of said mounted connectors faces the front opening of the frame and the second side of each of said mounted connectors faces the back opening of the frame;

selectively wiring the electrical contacts of the first side of the mounted connectors;

detaching the frame and orienting said frame such that the front opening faces the structure;

releasably reattaching the frame to the structure and the electrical ground connection such that the front opening faces the structure exposing the second side of all mounted connectors;

selectively wiring the electrical contacts of the second side of the installed connectors;

detaching the frame and re-orienting the frame such that the back opening faces the structure; and releasably reattaching the frame to the structure and the electrical connection such the back opening faces the structure.

12. The method of claim 11 wherein the step of selectively wiring the contacts further comprises the steps of removing connectors, mounting connectors and troubleshooting wires.

* * * * *